United States Patent [19]

Brenot

[11] 4,352,252

[45] Oct. 5, 1982

[54] STEAM GENERATOR WITH DIRECT EVAPORATION

[76] Inventor: Claude G. Brenot, 36, Chemin de la Cybellerie, Poitiers, France

[21] Appl. No.: 171,716

[22] Filed: Jul. 24, 1980

[30] Foreign Application Priority Data

Aug. 3, 1979 [FR] France ..... 79 20025

[51] Int. Cl.[3] ..... D06F 71/34

[52] U.S. Cl. ..... 38/16; 122/39; 219/275

[58] Field of Search ..... 38/1 B, 16, 77.5, 77.82, 38/77.83, 77.9; 122/39-41; 219/271, 335, 401, 275, 273

[56] References Cited

U.S. PATENT DOCUMENTS

| | | | |
|---|---|---|---|
| 1,150,355 | 8/1915 | French | 38/16 |
| 1,680,608 | 8/1928 | Garbutt | 122/39 |
| 3,490,158 | 1/1970 | Radford | 38/16 |
| 3,715,819 | 2/1973 | Hanson | 38/16 |

FOREIGN PATENT DOCUMENTS

| | | |
|---|---|---|
| 53994 | 2/1890 | Fed. Rep. of Germany . |
| 702986 | 4/1931 | France . |

*Primary Examiner*—Louis Rimrodt

*Attorney, Agent, or Firm*—Fulwider, Patton, Rieber, Lee & Utecht

[57] ABSTRACT

The invention relates to a steam generator with direct evaporation comprising a first plate provided with an inlet channel for a pressurized fluid to be evaporated, a second plate independent of the first plate and superposed thereon, a steam recovery cavity in communication with a peripheral part of the first and second plates, and an electric heating resistor located at least approximately in a plane parallel to said first and second plates. The pressurized fluid inlet channel opens out freely from the first plate perpendicularly thereto and to the second plate, in a central part of the generator, and has an outlet diameter greater than about 2.5 mm, and the face of the second plate located opposite the first plate is maintained applied against the corresponding face of the first plate by elastic return means.

The invention finds an application in hand-operated ironing presses.

11 Claims, 10 Drawing Figures

Fig 7
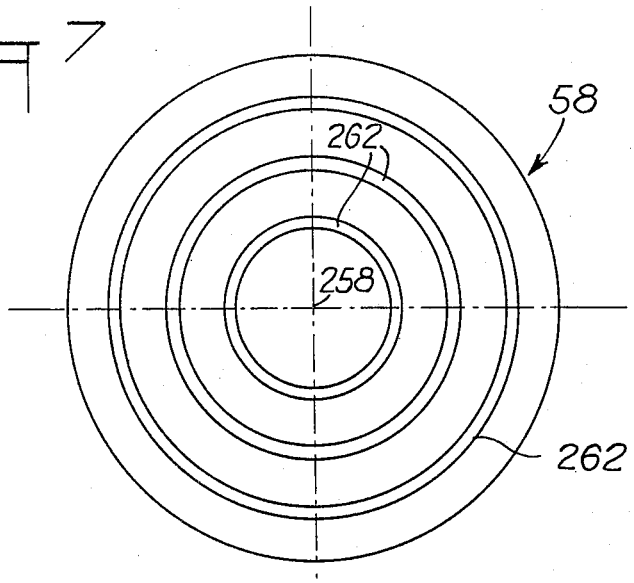
Fig 8
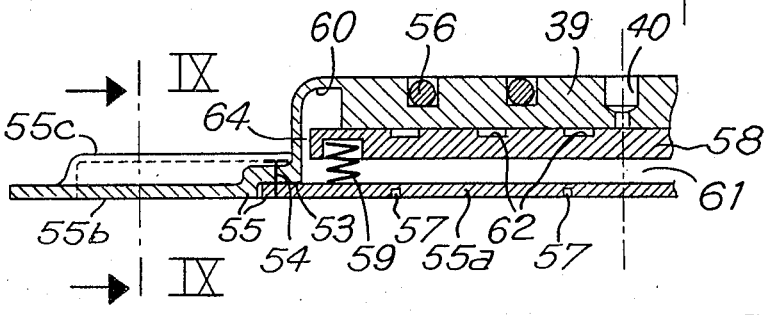
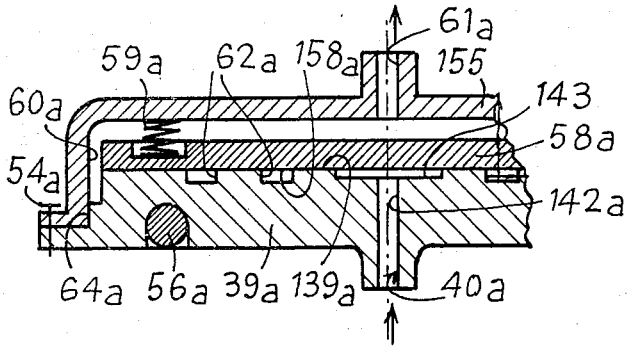
Fig 10
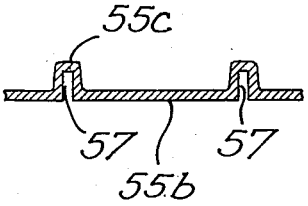
Fig 9

STEAM GENERATOR WITH DIRECT EVAPORATION

The present invention relates to a steam generator with direct evaporation, without accumulation of steam under pressure, comprising a first plate provided with at least one inlet channel for a pressurized fluid to be evaporated, a second plate, independent of the first plate and superposed thereon, a steam recovery cavity in communication with a peripheral part of the first and second plates, and an electric heating resistor located at least approximately in a plane parallel to said first and second plates.

Due particularly to its flattened evaporation surface cooperating with a shrouded electric resistor located at least approximately in a plane parallel to the evaporation surface, the said steam generator may effectively perform its function of instantaneously producing steam with small dimensions and without resorting to assemblies for storing pressurised steam. However, despite its simplicity, this type of steam generator of the prior art presents drawbacks due in particular to the problems raised by furring, particularly at the level of the spray for spraying the water on the evaporation surface.

It is an object of the present invention to remedy the above-mentioned drawbacks and to provide a steam generator with direct evaporation whose structure is simple and inexpensive to construct, whilst overcoming the defects of the steam generators of the prior art associated with fur deposits.

These objects are attained due to a steam generator of the type mentioned at the beginning of the specification, in which, according to the invention, the inlet channel for pressurised fluid opens freely from the first plate perpendicularly thereto and to the second plate, into a central part of the generator, and has an outlet diameter greater than about 2.5 mm, and the face of the second plate located opposite the first plate is maintained applied against the face of the first plate by elastic return means.

Insofar as the outlet orifice of the liquid to be evaporated is relatively large, there can no longer be a problem of furring at pressurised fluid supply level, contrary to the case of spray devices which, by definition, present orifices of very small dimensions. Furthermore, the evaporation is always produced effectively in view of the fact that a very thin laminary flow is created between the opposite faces of the first and second plates. Consequently, the phenomenon of calefaction is avoided.

According to an important feature of the present invention, the upper face of that of the first and second plates which is located in the lower part, is provided with an assembly of concentric grooves.

The concentric grooves formed define a plurality of concentric closed circuits without communication with one another.

The section of said concentric grooves may be in the form of a U.

According to another advantageous embodiment, said concentric grooves have an asymmetrical section and comprise walls whose slope is less on the side closest to the fluid supply than on the opposite side.

In this case, the concentric grooves comprise a progressive downward shoulder made from the side closest to the fluid supply and presenting a lower face comprising a convex surface with large radius of curvature followed by a concave surface of small radius of curvature, whilst a shallow groove is formed in the lower face of that of the first and second plates located in high position at least in the part located opposite the parts of concentric grooves of slight slope to form an abrupt shoulder.

It is advantageous if the plate provided with grooves presents a symmetry with respect to two rectangular axes whose intersection is located at the level of the zone facing the orifice for supply of fluid to be evaporated.

The electric heating resistor is integrated in the first fixed plate. The lower face of that of the first and second plates located in high position constitutes an evaporation surface which cooperates with the evaporation surface constituted by the upper face of the lower plate.

According to a particular embodiment, the lower face of the upper plate is perfectly smooth.

The steam generator according to the invention is universal and may be adapted to numerous applications necessitating the production of steam at low cost with strict conditions of reliability and operational safety. The application to irons or to ironing presses proves to be particularly advantageous.

The invention will be more readily understood on reading the following description with reference to the accompanying drawings, in which:

FIGS. 5, 6 and 7 show variant embodiments of the second plate of FIG. 2, FIG. 8 is a transverse half-section of a variant embodiment of the steam generator of FIG. 1, and FIG. 9 is a section along line IX—IX of FIG. 8, and FIG. 10 is a transverse half-section of another embodiment of the steam generator.

Figure 1:
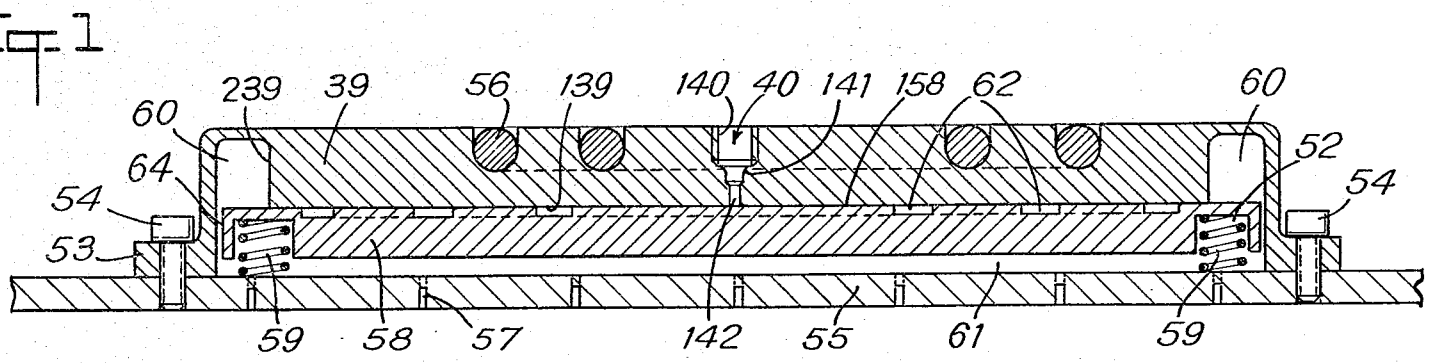
FIG. 1 is a view in transverse section of a steam generator according to the invention.

Referring now to the drawings, FIG. 1 shows a steam generator comprising a fixed upper plate 39, in which is incorporated a heating resistor 56, a mobile lower plate or counterplate 58 abutting via springs 59 on a base 55 constituted for example by the sole of an ironing press.

The upper plate 39 (FIGS. 1 and 3) comprises a peripheral flange 53 which rests on the sole 55 and is fixed thereto by means of connecting elements 54. A peripheral cavity 60 for recovering steam is formed in the upper plate 39 to collect the steam formed in contact with the lower face 139 of the upper heating plate 39 and the upper face 158 of the counterplate 58, when pressurised water supplies the central channel 40 formed in the upper plate 39. The peripheral cavity 60 of the upper plate 39 is itself in communication by a narrow annular slot with a steam distribution chamber 61 constituted by the free space between the lower face of the counterplate and the sole 55.

The counterplate 58 is permanently applied against the upper plate 39 by means of the springs 59 which are engaged in housings 32 formed in the peripheral part of the counterplate 58.

The peripheral cavity 60 enables a sufficient space to be made between the outer edge of the upper plate 39 which terminates in the lower support flange 53 and the main mass of the plate 39 heated by the resistor 56. In fact, the plate 39 is subjected to deformations due to temperature variations. The peripheral groove 60 precisely enables deformations to be absorbed without the lower surface 139 of the plate 39 itself being affected, and further allows the thermal bridges to be reduced. Furthermore, the peripheral cavity 60 constitutes a free volume where the steam coming from the restricted space between the plates 39 and 58 may expand and consequently ensure that even the residual drops of water are evaporated.

The lower plate preferably projects a little beyond the edge 239 constituting the peripheral part of the main heating part of the plate 39. The lower plate 58 is in fact subjected to slightly less stress than that to which the upper plate 39 is subjected. In addition, the presence of a peripheral slot 64 of relatively reduced width between the plate 58 and the outer support edge of the plate 39 allows an easier centering of the mobile lower plate 58 whilst constituting a new barrier for the possible drops of water which, due to capillarity, cannot pass from the peripheral cavity 60 to the distribution chamber 61. However, it will be noted that the distribution chamber 61 is not indispensable for all applications. In particular, the steam might be collected in a pipe opening in the recovery cavity 60 (cf. FIG. 10).

The electric heating resistor 56 may be constituted by a shrouded resistor disposed for example in a coil (FIG. 3), and located substantially in a plane parallel to the plane of contact between the faces 139 and 158 of the plates 39 and 58 respectively, which plane of contact is itself parallel to the sole 55. The upper plate 39 constitutes a heating plate in which the heat is substantially uniformly distributed. This arrangement is advantageous for safety reasons as the electric resistor is placed outside of the water and steam circulating zones.

The channel 40 for supplying pressurised fluid to be evaporated may comprise (FIG. 5) a first portion (140) of relatively large section to facilitate connection to an inlet pipe for liquid, which may, furthermore, come from a tank located in the immediate vicinity of the steam generator, and portions 141, 142 of smaller section in the vicinity of the outlet of the channel, the different sections corresponding to connectors of standard type. However, it is essential that the smallest section 142 of the channel 40 does not have too small dimensions in order to eliminate any risk of furring and to facilitate the functioning of the system. It is thus indispensable that the liquid may flow freely at the outlet of the pipe 40. Consequently, no spray or other device must be added to the pipe 40. The section of the pipe 40 is preferably greater than about 2.5 mm at all points and the pipe may have for example an outlet section close to 4 mm at the level of section 142, or generally a section similar to that of the liquid supply pipes.

The upper face 158 of the counterplate 58 (FIG. 2) is advantageously provided with a series of concentric grooves 62 each forming a closed circuit. The purpose of the grooves 62 is both to trap the nonevaporated drops of water in order to prevent these drops from moving towards the periphery of the counterplate 58 and penetrate in the steam receiving cavity, and to ensure a homogeneous distribution of the steam and the film of water to be evaporated over the whole surface 158 of the counterplate 58. Thus, an assembly of equidistant grooves 62 is preferably formed, regularly distributed over the surface 158 around the central part 258 located opposite the inlet of liquid through the channel 40. The plates 39 and 58 and grooves 62 are advantageously symmetrical with respect to two rectangular axes intersecting substantially at the level of the part opposite the outlet orifice 142 of the fluid supply channel 40.

Figure 2:
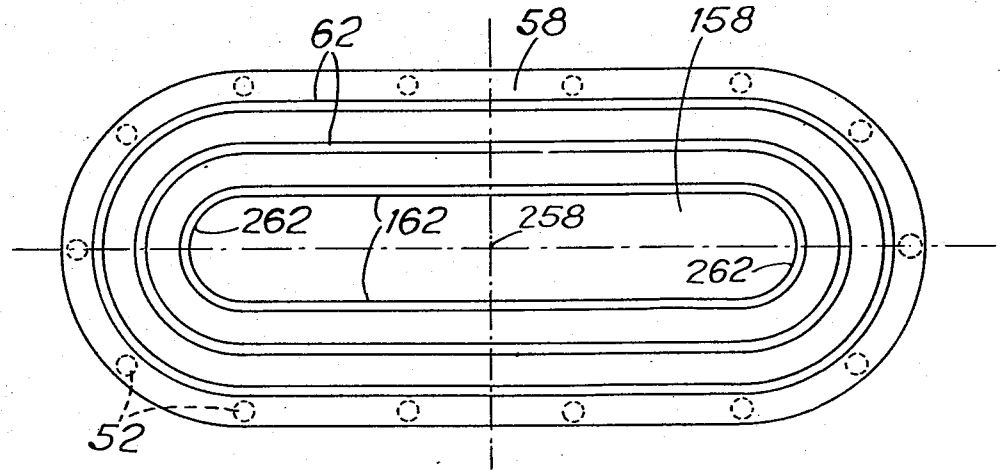
FIG. 2 is a plan view of the second plate of the steam generator of FIG. 1.
Figure 3:
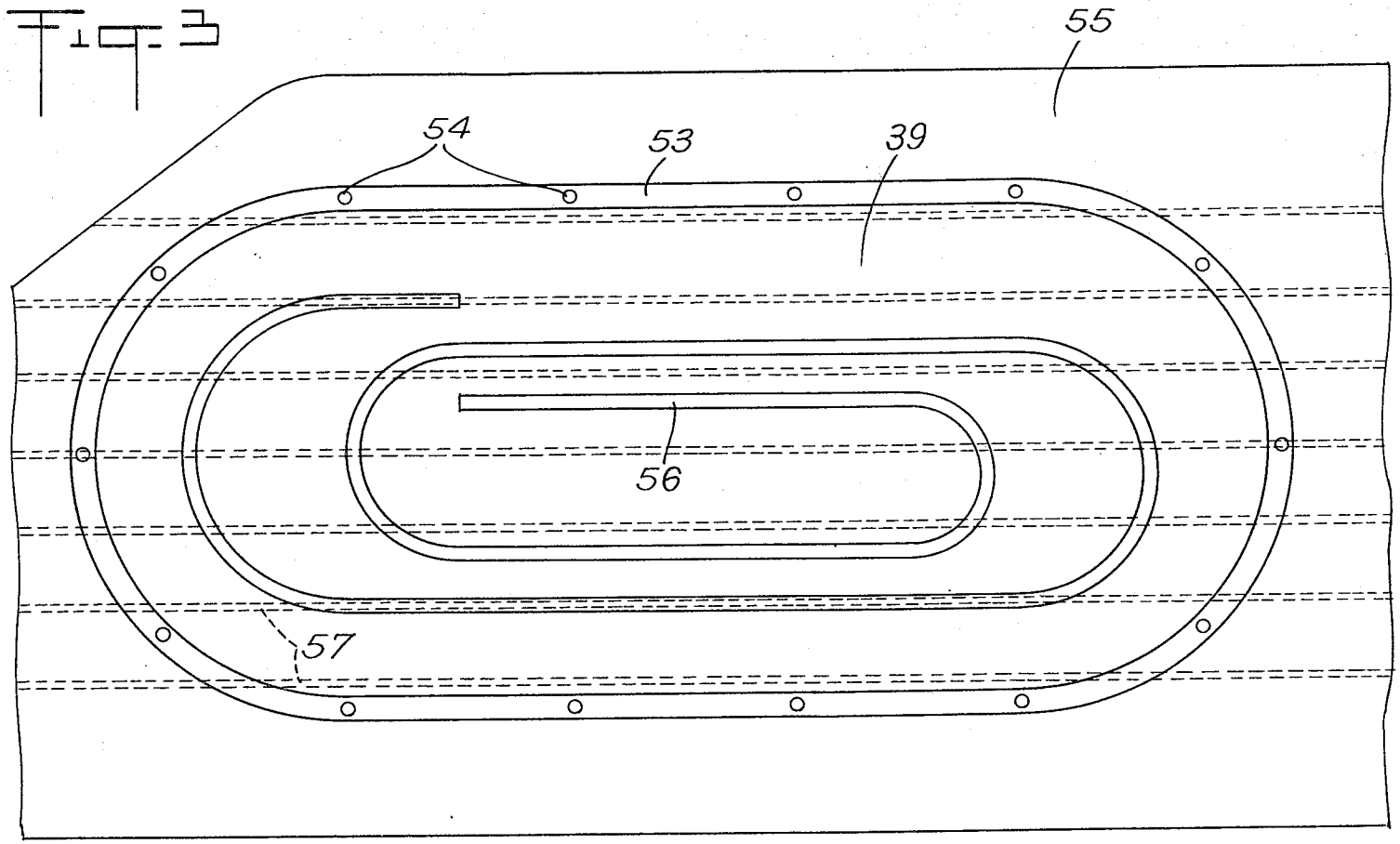
FIG. 3 is a plan view of the steam generator of FIG. 1.

In the case of the plates 39 and 58 of the steam generator being oblong in form, as shown in FIGS. 2 and 3, each plate may comprise a rectangular, elongated central part extended at its two lateral ends by half discs. In this case, the grooves 62 advantageously present two rectilinear parts 162 (FIG. 2) parallel to the longitudinal axis of the plate 58, and two circular end portions 262 whose centre of curvature is merged with the centre of curvature of a rounded end part of the plate 58 itself. This configuration ensures a very good distribution of the steam and therefore of the pressure from the centre 258 of the plate 58 up to the periphery thereof which is located in the vicinity of the cavity 60. Furthermore, the absence of radial grooves connecting the various grooves 62 together ensures that the non-evaporated drops of water are retained. It should be noted that the water arriving through channel 40 is veritably compressed to form a thin film between the plates 39 and 58. This crushing occurs whatever the possible furring of the surfaces 139 and 158, since the space between these surfaces is not fixed, but is determined on the one hand by the force exerted by the springs 59 to apply the plate 58 against the heating body 39 and on the other hand by the pressure of the liquid arriving through the channel 40, which liquid tends to space the plate 58 very slightly apart to allow the passage of a thin film of liquid between the two surfaces 139 and 158, which film is then converted almost instantaneously into steam in contact with the hot walls 139 and 158. In fact, the lower plate 58 always remains in the immediate vicinity of the upper heating plate 39 and, when functioning is intermittent, even has its upper face 158 applied against the lower heating plate 139 of the plate 39, since no liquid pressure opposes the action of the springs 58. The face 158 is then heated very effectively.

The face 139 of the upper plate 39 is preferably perfectly smooth. However, in certain cases, especially for particular configurations of the plates, certain grooves may be made in the wall 139 of the plate 39.

Naturally, the most varied forms may be adopted for the plates 39 and 58. Thus, a star configuration may be provided. A perfectly circular form is also very advantageous. Thus, in FIGS. 2 and 3, it suffices to eliminate the central rectangular part of the plates 39 and 58 and of the grooves 162 to have plates in the form of circular discs, the lower plate 58 comprising likewise perfectly circular grooves 262 (FIG. 7).

Figure 5:
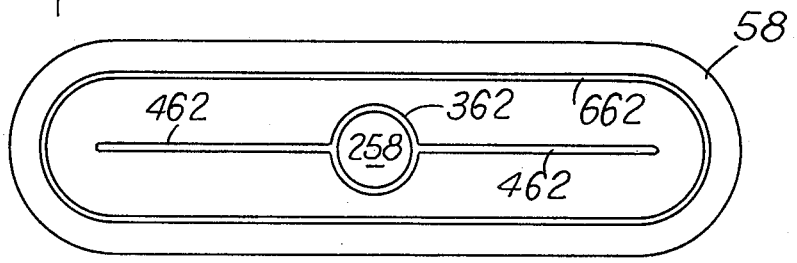
Figure 6:
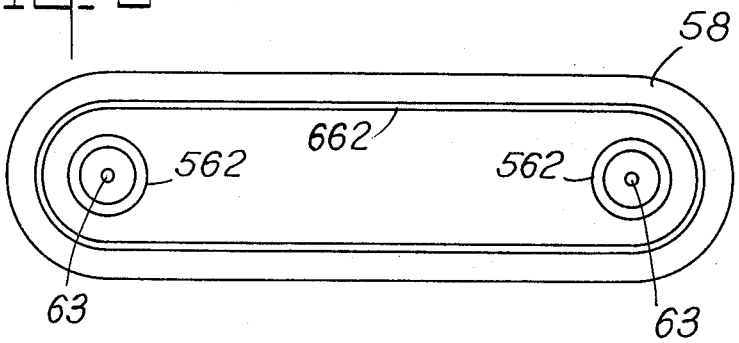

FIGS. 5 and 6 show variant embodiments of elongated lower plates 58 which comprise supplementary means for facilitating distribution of the steam in the longitudinal direction. It will be noted that the means shown in FIGS. 5 and 6, or equivalent means, may be used each time the steam generator presents plates 39 and 58 which are not of revolution about the axis of the fluid inlet orifice. In this case, in fact, contrary to the case of FIG. 7, the distribution of the steam could be made more difficult in the directions of larger dimensions of the plates.

In order to improve the distribution of the steam in the case of FIG. 5, the plate 58 is provided, in addition to a group of concentric grooves 362, 662 centred on the zone 258 located opposite the fluid outlet orifice, with rectilinear grooves 462 extending along the longitudinal axis of the plate 58 and in communication with the groove 362 closest to the zone 258. However, it is important to note that the radial grooves 462 terminate at a distance from the first concentric groove 662 surrounding the annular central groove 362, in order to avoid any communication between two adjacent concentric grooves. The number of radial grooves and closed concentric grooves may of course vary as a function of the applications and especially the dimensions of the plate 58.

In FIG. 6, steam outlet orifices 63 are arranged in the vicinity of the peripheral part of the plate 58, and preferably at the centre of curvature of the rounded parts of the plate. These orifices are in communication with a part of the chamber 61 of FIG. 1, which chamber then constitutes with the peripheral cavity 60 a steam recovery zone. In fact, the steam may always be evacuated through the peripheral part of the plate 58. However, the additional steam outlet orifices contribute to creating a pull of steam which facilitates transfer thereof along the longitudinal axis of the plate 58. In order to prevent any passage of drops of water through the orifice 63, annular grooves 562 are formed around the orifices 63. One or more peripheral grooves 662 are formed on the plate 58 in the manner described hereinabove in order to trap the water upon evacuation of the steam at the outer edge of the plate 58.

Figure 4:
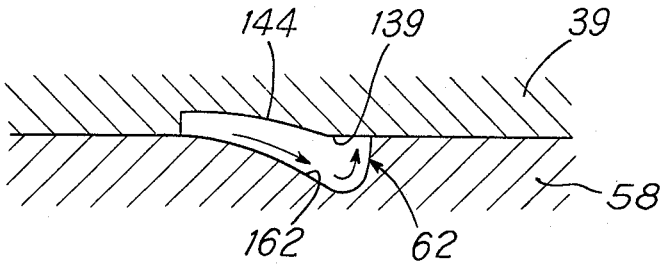
FIG. 4 is a detailed view in section showing a variant embodiment of the grooves of the second plate.

The grooves 62 may present various forms according to the applications envisaged. A U-section, as shown in FIG. 1, is very easy to make. However, a section corresponding to the one shown in FIG. 4 is also advantageous. In fact, this groove form 62 comprises a progressive shoulder 162 from the side of the groove nearest the zone 258 where the liquid is introduced on the plate 58, then a second steeper wall part on the opposite side of the groove. The first wall part 162 may thus be slightly convex with a larger radius of curvatures, whilst, after a point of inflexion constituting the bottom of the groove, the wall part opposite the first part 162 is steeper and concave. It is known that by the Coanda effect the fluid tends to follow and become attached to the wall, which, with the form described in FIG. 4, ensures a better trapping of the drops of water in the bottom of the groove. The upper face 139 of the upper plate 39 may in this case comprise a shallow groove 144 at least in the part located opposite the groove part 162 in order to constitute an abrupt shoulder which prevents the drops of water from being attached to the upper wall.

The sole 55 which constitutes the bottom of the steam chamber 61 in the case of application to an iron or an ironing press may conventionally comprise holes for passage of the steam. However, for a better distribution of the steam, it is preferably if these holes do not open out at points on the lower surface of the sole 55, but in narrow grooves 57 (FIGS. 1 and 3) which mark the linen to be ironed less.

In the steam generator device according to the invention, it is important if an upper heating plate which incorporates a channel for supply of pressurised liquid, cooperates with a lower plate applied by means of springs against the lower face of the upper plate which constitutes one of the two evaporation surfaces. The presence of grooves in the lower plate, as well as the production of a smooth evaporation surface cooperating with at least corresponding smooth parts of the lower plate also constitute important features. However, various variant embodiments may be envisaged. The upper plate 39 and at least part of the sole 55, whose relative positions are fixed, may be made in one piece by casting. The counterplate 58 may in this case be introduced from underneath, during assembly, through a dismountable central part of the sole 55.

FIG. 8 precisely shows a variant embodiment of the generator of FIG. 1 in which the upper plate 39, its outer edge and its lower support flange 53 are mounted in one piece with a part **55*b* forming sole, particularly for application to an iron or ironing press. The sole 55 is then constituted by a peripheral part 55*b* and a central part 55*a* connected by connecting means 54 to the plate 39 and placed in alignment with the part 55*b*. This embodiment particularly enables the plate 58 to be introduced or withdrawn from underneath simply by removing the plate 55*a*, which may be of small thickness. As may be seen in FIGS. 8 and 9, the part 55*b* of the sole may comprise reinforcing ribs 55*c* which serve at the same time as steam distribution slots in the case of the slots 57 of the ribs 55*c* being in communication with chamber 61. It will be noted that the embodiment of FIGS. 8 and 9 ensures a perfect tightness with respect to steam in the upper part. In fact, the upper plate 39 and its peripheral parts 53, 55*b* constitute a tight cover so that all the steam formed can escape only through the underneath of the sole 55**.

Numerous modifications and additions may be made to the devices without departing from the scope of the invention. For example, in certain cases, if the steam generator has a large surface, a plurality of water inlet channels may be formed in the upper plate 39. In this case, of course, the water inlet orifices must always be free, i.e. without nozzle or spray located at a distance from one another, and each surrounded by a network of concentric grooves of the type described hereinabove.

Furthermore, as has been stated above, the faces 139 and 158 (except the presence of the grooves 62) of the plates 39 and 58 are preferably flat. However, these faces 139 and 158 may also present a slightly convex form, for example spherical or cylindrical with the same relatively large radius of curvature, the faces 139 and 158 therefore always being complementary of each other.

FIG. 10 shows another embodiment of the steam generator according to the present invention. In this embodiment, contrary to those previously described, the heating plate **39*a* is disposed beneath the mobile plate 58*a*, but the functioning remains the same insofar as the evaporation of the water introduced through the central channel 40*a* made in the heating plate 39*a*, is always produced in contact with the faces 139*a* and 158*a* respectively of the plates 39*a* and 58*a*, which faces 139*a* and 158*a* are located opposite each other and are applied against each other under the action of the springs 59*a* which exert a downward pressure on the plate 58*a*. A heating resistor 56*a* is incorporated in the plate 39*a* and is located, as in the preceding embodiments, in a plane substantially parallel to the evaporation surfaces 139*a* and 158*a***.

The pressurised fluid inlet channel **40*a* preferably opens into a chamber 143, this making it possible to use, for supplying fluid in the channel 40*a*, only relatively moderate pressures obtained with small, currently used pumps, whilst ensuring that, at chamber 143 level, the pressure exerted by the fluid counterbalances that exerted by the springs 59*a* so as to make the thin passage necessary for the film of fluid to be evaporated between the surfaces 139*a* and 158*a***.

It will be noted that in the case of the embodiment of FIG. 10, the grooves 62*a* similar to grooves 62 are made in the lower plate which is in that case the fixed plate 39*a*. The steam which escapes at the periphery of the plates 39*a* and 58*a* is collected in the peripheral cavity 60*a* and may be evacuated through the pipe 61*a* located in the upper part of the steam generator. The upper outer casing 155 on which the springs 59*a* abut, is made fast with the lower plate 39*a*, for example by connecting means 54*a*.

There is preferably a small clearance, when cold, between the outer lateral face 64*a* of the lower plate 39*a* and the corresponding lateral face of the casing 155. This clearance may, however, be provided so that, when hot, i.e. when the generator is being used, the expansion of the plate 39*a*, heated by the resistor 56*a* makes it possible automatically to effect centering and tightness between the plate 39*a* and the casing 155, the lateral face 64*a* then coming into contact with the casing 155.

The presence of a heating plate 39*a* located beneath the mobile plate 58*a* generally leads to a better thermal yield of the steam generator.

The generator of FIG. 10 may, like the preceding embodiments, be applied to an ironing press, and may for example be incorporated in the lower plate. This generator for the instantaneous production of steam is also particularly adapted to constitute an independent element which may be incorporated in devices for steaming off wall-paper for example.

What is claimed is:

1. In a steam generator with direct evaporation, without accumulation of pressurised steam, comprising a first plate provided with an inlet channel for a pressurised fluid to be evaporated, a second plate independent of the first plate and superposed thereon, a steam recovery cavity in communication with a peripheral part of the first and second plates, and an electric heating resistor located at least approximately in a plane parallel to said first and second plates, the pressurised fluid inlet channel opens out freely from the first plate perpendicularly thereto and to the second plate, in a central part of the generator, and has an outlet diameter greater than about 2.5 mm, and the face of the second plate located opposite the first plate is maintained applied against the corresponding face of the first plate by elastic return means.

2. The steam generator of claim 1, wherein the upper face of that of the first and second plates located in the lower part is provided with an assembly of concentric grooves.

3. The steam generator of claim 2, wherein said concentric grooves define a plurality of concentric closed circuits without communication with one another.

4. The steam generator of claim 2, wherein the section of said concentric grooves is in the form of a U.

5. The steam generator of claim 2, wherein said concentric grooves have an asymmetrical section and comprise walls whose slope is less on the side nearest the fluid supply than on the opposite side, a progressive downward shoulder is made from the side of the grooves nearest the fluid supply, the grooves having a lower face comprising a convex surface of large radius of curvature, followed by a concave surface of small radius of curvature, and a shallow groove is formed in the lower face of that of the first and second plates located in high position, at least in the parts located opposite the parts of concentric grooves of slight slope.

6. The steam generator of claim 2, wherein it presents a symmetry of revolution around the supply orifice of the fluid to be evaporated.

7. The steam generator of claim 1, wherein the electric heating resistor is integrated in the first plate and the lower face of that of the first and second plate located in high position constitutes an evaporation surface which cooperates with the evaporation surface constituted by the upper face of that of the first and second plates located in lower position.

8. The steam generator of claim 1, wherein the lower face of that of the first and second plates located in high position is perfectly smooth.

9. The generator of claim 1, wherein that of the first and second plates located in the lower part comprises additional localised means constituted by portions of radial groove to promote the circulation of steam in the directions of greatest dimension of the plate.

10. The steam generator of claim 1, wherein that of the first and second plates located in the lower part comprises additional localised means constituted by steam escape orifices surrounded by circular grooves, to promote the circulation of steam in the directions of greatest dimension of the plate.

11. A steam press equipped with a generator with direct evaporation, without accumulation of pressurised steam, comprising:

a press sole, a first plate fast with the press sole and provided with an inlet channel for a pressurized fluid to be evaporated, a second plate independent of the first plate and located therebeneath a steam recovery cavity in communication with a peripheral part of the first and second plates, a steam chamber located under the second plate immediately above the press sole and communicating with the steam recovery cavity, elastic return means abutting on the press sole and exerting a pressing action on the second plate to apply the latter against the lower face of the first plate, and an electric heating resistor located at least approximately in a plane parallel to said first and second plates, wherein the pressurized fluid inlet channel opens out freely from the first plate perpendicularly thereto and to the second plate, into a central part of the generator, and has an outlet diameter greater than about 2.5 mm.

* * * * *